US005434557A

United States Patent [19]

Alizi

[11] Patent Number: 5,434,557

[45] Date of Patent: Jul. 18, 1995

[54] INTRUSION DETECTING APPARATUS

[76] Inventor: Uri Alizi, 21 Haetzel Street, Herzlia Pitauch, Israel

[21] Appl. No.: 932,095

[22] Filed: Aug. 19, 1992

[30] Foreign Application Priority Data

Aug. 21, 1991 [IL] Israel ..... 99266

[51] Int. Cl.[6] ..... G08B 13/10

[52] U.S. Cl. ..... 340/555; 340/556; 340/666; 340/668

[58] Field of Search ..... 340/555, 556, 668, 666

[56] References Cited

U.S. PATENT DOCUMENTS 4,521,767 6/1985 Bridge ..... 340/555
4,533,906 8/1985 Amir ..... 340/666
4,829,286 5/1989 Zui ..... 340/555
5,055,827 10/1991 Philipp ..... 340/555

*Primary Examiner*—Glen Swann

*Attorney, Agent, or Firm*—Keck, Mahin & Cate

[57] ABSTRACT

In an intrusion detection system, at least one optical cable is provided, through which light enters at one of its ends and exits at the other end, at which other end a device for detecting changes in the light intensity passing through the cable is also provided. The system is usually part of a fence, but it can be used in structures such as roofs, windows, etc. When an intruder exerts force on the optical cable, its movement actuates a mechanical device so that a member thereof exerts pressure at a certain place on the cable, deforming the optical cable and causing light attenuation which is detected and actuates an alarm. When used as part of a fence, such mechanical sensing devices are provided at certain intervals from each other. Optical cables can be provided at different heights of such a fence, with light intensity attenuation means as described above.

6 Claims, 7 Drawing Sheets

INTRUSION DETECTING APPARATUS

FIELD OF THE INVENTION

The invention relates to an intrusion detecting apparatus serving as intruder detector and barrier, which comprises a tensioned, optical cable and connected to an alarm system and adapted to activate said system whenever an intruder cuts it or attempts to climb over the cable, and in general, whenever the cable is displaced or bent; said apparatus being adapted to be coupled to a fence of any type, in particular an optical security fence, but being usable, if desired, independently of any such fence, e.g. as the upper part of a fence, wall etc. or as an independent fence, or parallel to an existing fence.

BACKGROUND OF THE INVENTION

Intrusion detector apparatus - being part of or coupled with security fences, in particular fences comprising optical fibers, or not - are known which comprise taut wires and alarm systems; means are provided for activating the alarm system whenever an intruder cuts the taut cable or attempts to climb over it and therefore causes a displacement in it. In some apparatus disclosed in the prior art, the alarm system is activated whenever light transmission through optical fibers, that are part thereof or associated therewith, is decreased beyond a certain threshold limit, said decrease occurring in response to loads placed on the taut wire.

For instance, U.S. Pat. No. 4,829,286 describes such an apparatus in which a taut wire is mechanically connected to an optical fiber and causes bending of the optical fiber and reduction of the light transmission therethrough whenever the taut wire undergoes displacements due to a load of sufficient magnitude applied to it. However, a device of this kind has several disadvantages. Thus, it is possible by relatively simple mechanical means to neutralize loads on the taut wire, e.g. by applying a suitable traction between two spaced points thereof and then cutting it therebetween. Furthermore, temperature changes beyond a certain limit, winds and other phenomena may cause abnormal displacements in the wire and therefore produce false alarms or, conversely, make the wire less sensitive to load applied to it. Furthermore, the bending of the optical fiber in response to the displacements of the metal taut wire is often not of a magnitude sufficient to provide such a reduction of the light transmission as will provide the alarm, and the cited U.S. patent attempts, by mechanical means, to enhance the bending of the optical fiber to overcome this drawback; and also to avoid false alarms due to slow displacements of the taut wire by providing a viscous material as a component of the mechanism connecting the taut fiber with the optical fiber. However, the structures so provided are complicated and of uncertain efficiency.

It is a purpose of this invention to provide an intrusion alarm system, comprising a tensioned cable and an alarm system, which will provide an alarm in response to the cutting of the cable and to any load or displacement thereof, due to an intrusion attempt, while being insensitive to loads due to other causes, in particular environmental causes, such as temperature changes, wind pressure, etc.

It is another purpose of the invention to provide such a structure which is reactive to localized loads, to cause an alarm, but is not reactive to broadly applied, balanced loads which, by their nature, are not normally due to intrusion attempts.

It is a further purpose of the invention to provide such a structure which requires no displacement enhancing means and is responsive to the loads due to intrusion attempts.

It is a still further purpose of the invention to provide such a structure which is extremely simple and economical and of reliable operation and is free of malfunctions.

Other purposes of the invention will appear as its description proceeds.

SUMMARY OF THE INVENTION

The aforesaid purposes of the invention are achieved by an intrusion detection structure which comprises at least an upper tensioned cable, which is made of or comprises optical fibers - hereinafter, called "optical cable" - said optical cable being arranged in a number of consecutive sections, and further comprises mechanical sensing means, located between adjacent sections of said optical cable, for sensing differential displacements of the optical cable sections between which they are located, to cause attenuation in the light transmission through the optical cable, whereby to activate an alarm system.

Of course, as in all the security systems comprising optical fibers, each optical cable is connected to a light emitter and a light receiver, and provides a continuous light transmission path therebetween, the light receiver in turn being connected to the alarm system whereby to cause an alarm to be given if the light received by it is reduced by more than a predetermined amount.

Preferably, said means for sensing differential displacements of the optical cable sections comprise mechanical elements displaceable, as a result of said differential displacements, from a normal position, and comprising means inactive in said normal position and active in the displaced positions of said mechanical means for engaging the optical cable and decreasing the light transmission through it. Preferably, said sensing means also comprise means for urging them to remain in and/or returning to their normal position.

DETAILED DESCRIPTION OF PREFERRED EMBODIMENTS

Preferably, the differential displacement, mechanical sensing means cause attenuation of the light transmission through the optical cable, with which they are associated, by sharply bending it and/or pressing on it and/or exerting on it a pinching action. For this purpose, they preferably comprise pressure means inactive in a normal position, in which they do not contact, or at least do not deform, the optical cable, and displaceable to an active position, in which they exert a concentrated pressure on said cable and tend to displace it in the direction of their own displacement, Preferably, the resulting displacement of the cable is limited by limiting means, which cooperate with the pressure means to deform the cable. In a preferred embodiment, the pressure means are tapered to a dull edge in the direction of their displacement to the operative position and the limiting means are provided with corresponding recesses, or grooves, which permit displacement and/or deformation of the cable as a result of the pressure means abutting the cable and driving it into one of said recesses, while limiting displacement of the cable at the sides of said one of said recesses. Preferably, the displacement of the pressure means is a rotation about a fixed pivot, caused by a rotary moment produced by the displacement of the cable in frictional engagement with an element of the mechanical sensing means.

Figure 2:
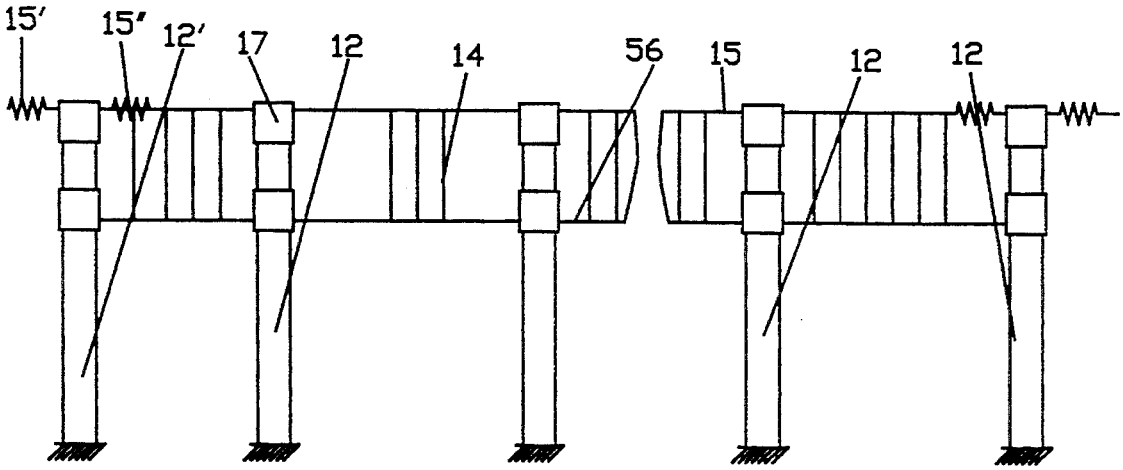
FIG. 2 is a schematic, vertical, front view of the apparatus of FIG. 1.
Figure 3:
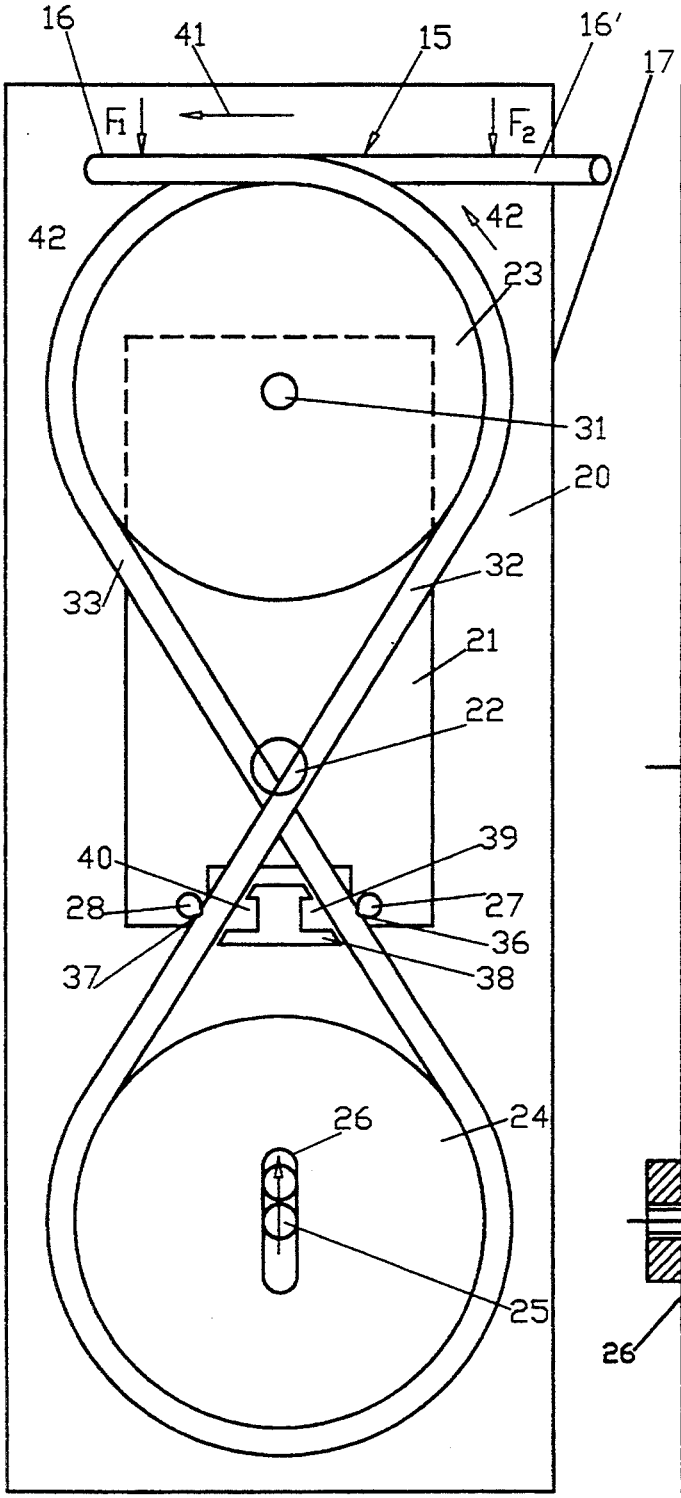
FIG. 3 is a detail of the apparatus of FIG. 1, and specifically it is a vertical, front view of the an embodiment of the differential displacements mechanical sensing means, shown in the normal, inactive position.
Figure 4:
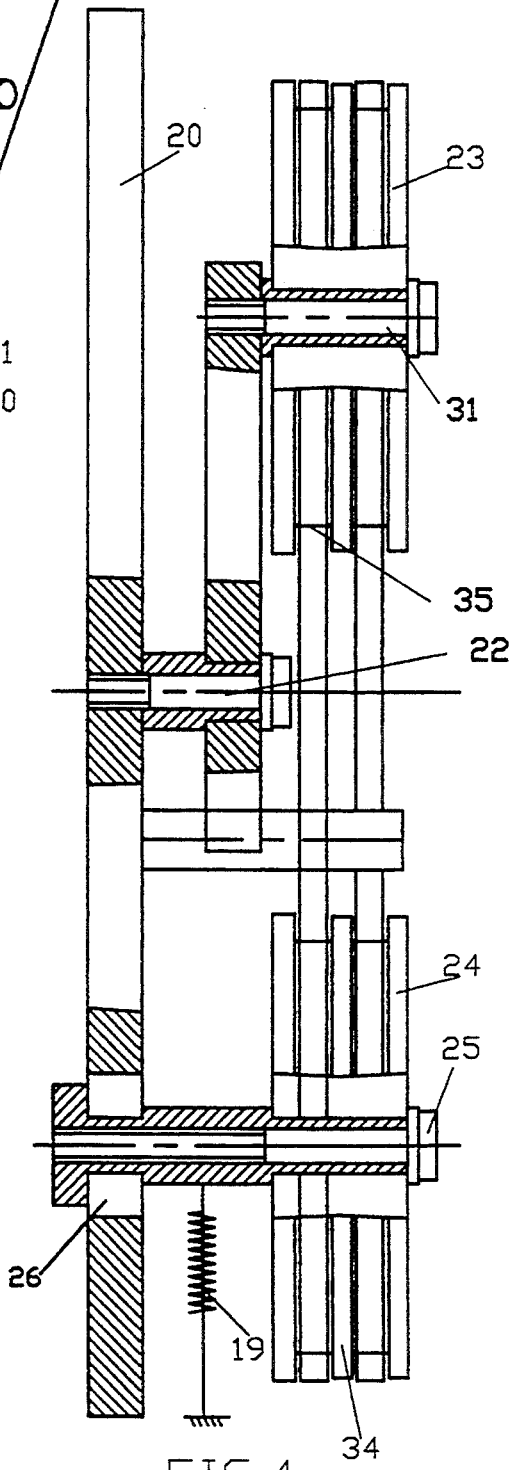
FIG. 4 is an axial, vertical cross-section of the detail of FIG. 3.
Figure 5:
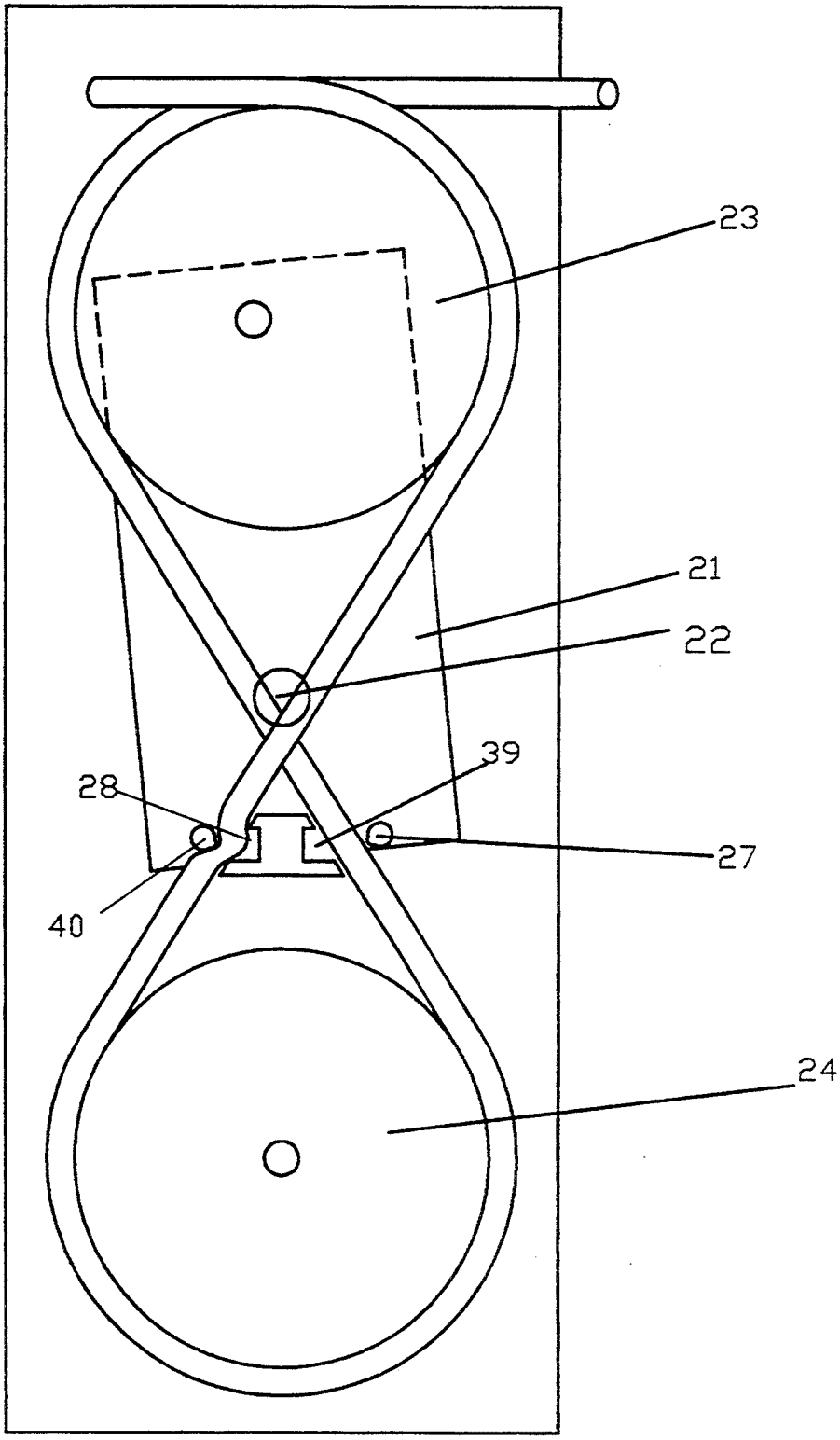
FIG. 5 shows the same detail of FIG. 3, but in displaced position, wherein it is active to reduce light transmission through the optical cable.

With reference now to the drawings, numeral 10 generally designates a barrier with which the apparatus according to this embodiment of the invention is associated and which may be a security fence embodying optical fibers and having any convenient structure or it may be a wall or any other barrier. Barrier 10 is only symbolically illustrated, and is omitted from FIG. 2,, as it is not, per se, part of the invention. Numeral 11 generally an apparatus according to an embodiment of the invention, which comprises any number of sections, each of which may have any desired length, e.g. between 10 and 100 meters. FIG. 2 only illustrates one such section, all the others being similar. Each section comprises a number of sub-sections, extending between two posts 12, only a few of such sub-sections being illustrated in FIG. 2. Posts 12 are only schematically illustrated in FIG. 2, since they may have any convenient structure, though a particular structure thereof will be later illustrated by way of example. A number of cables 15 are provided, at least the uppermost of which is an optical cable but which are preferably all such cables, only two such cables being shown in FIG. 2 for simplicity's sake. A number of vertical spacers 14 are also provided in each sub-section of the apparatus, for maintaining the required vertical distance between the cables 15. Cables 15 are placed under tension by any suitable means, schematically indicated in the drawing by springs 15' and 15''. By "optical cable" is meant herein, a cable which is made of or comprises at least one optical fiber, and preferably a plurality of such fibers, provided, if desired, with suitable coverings, such as sheaths or coatings, made of non-optical material, e.g. plastic material. Any desired number of differential displacement, mechanical sensors, generally indicated at 17 and illustrated in detail in FIGS. 3 to 5, are attached in a fixed manner to posts 12. Preferably, one such sensor is attached to each post for each cable 15, as schematically indicated in the drawing.

The mechanical sensor 17 comprises a base plate 20 which is fixed to a terminal post 12 or to a support rigidly attached to it. A pulley 24 is pivoted on shaft 25, which in turn is slidable upwardly in a preferably vertical slit 26 of base plate 20. Shaft 25, and with it wheel 24, is constantly urged downwards by tension spring 19. A plate 21 is pivoted on pivot 22 which is mounted on base plate 20. A second pulley 23 is mounted on pin 31 which is fixed to plate 21. An optical cable 15 is wound about pulley 23, enveloping an arc (slightly more than 180° in the drawing) thereof, is then stretched between pulley 23 and pulley 24 forming a straight segment 33, is wound about this latter in a groove 34, enveloping an arc thereof, is then stretched back to pulley 23, forming a straight segment 32 which crosses over segment 33 at 22 to form an angle a thereto, is further wound about pulley 23 in a groove 35, and then stretched in another section of the fence - to the left-hand of Post 12 as seen in FIG. 2 - at the end of which it will reach another mechanical sensor 17 attached to post 12'.

The plate 21 carries two pressers 27 and 28, which are preferably provided with relatively sharp projections 36 and 37, which contact the branches 32 and 33 of cable 15 below the point at which they cross over one another. A generally trapezoidal stop member 38 is fixed to the base plate 20 within the angle a formed by the branches 32 and 33 of cable 15 below said point at which they cross over one another. Stop member 38 is formed with two recesses, 39 and 40, facing the pressers 27 and 28.

If a load is applied to the cable 15 at one side of the mechanical sensor 17, e.g., in the section of the apparatus to the left (as seen in FIG. 3) of the post 12 to which the sensor is attached, e.g., because an intruder attempts to climb the fence in that section, the cable will tend to become displaced in the direction of arrow 41, and this displacement and the resulting tension increase will be communicated successively to the arc thereof which envelops pulley 23 in groove 35, to cable segment 32, to the arc of the cable which envelopes pulley 24, and to cable segment 33. As a result, pulley 24 with its pivot 25 will be displaced upwards, the pivot sliding in slit 26. Further, the frictional engagement between cable 15 and pulley 23 will apply a tangential force on this latter, as generally indicated by arrow 42, which will be transmitted through pin 31 to plate 21, and the moment of said force with respect to pivot 22 will cause plate 21 to rotate about said pivot, in this case in a counterclockwise direction, as seen in the drawings, assuming the position shown in FIG. 5. This will shift pressor 28, which will bear on segment 32 of cable 15, but since this latter cannot yield freely, because of the presence of stop member 38, it will be bent inside recess 40. Thus, not only will cable 15 be sharply bent and assume a strong curvature, but it will also be pinched between the pressor and the stop member, and both deformations will cooperate to decrease the light transmission through the cable to such an extent that even if the original displacement of cable 15 is small, the corresponding light receiver will react and activate the alarm system.

If the load is placed on the cable at the right-hand side of post 12 and of the mechanical sensor, as seen in FIG. 3, the same phenomena will occur, except that pressor 27 will urge the segment 33 of cable 15 towards recess 39 of member 38. The functional result will be the same.

However, if similar loads are placed on both sides of a mechanical sensor 17, cable 15 will be placed under tension and pulley 24 with its shaft 25 will rise, but no rotational force will be exerted on pulley 23 and no moment about pivot 22 will be generated, so that plate 21 will not rotate. As a result, no bending or pinching of cable 15 will occur, and no alarm will be sounded. This will happen if, e.g., the cable 15 shrinks because of temperature changes or of wind pressure. If, for any reason, a slack should occur in the tension of cable 15 on both sides of a sensor. 17, pulley 24 and its shaft 25 will shift downwards and likewise no alarm will be sounded. In any case, spring 19 tends to urge the system at all times towards its normal, inactive position shown in FIG. 3. It has been found that if slow displacements of the wire occur for unforeseen reasons, such as shifting of the terminal posts or the like, or if a force is permanently applied for any reason to the optical cable in one section thereof, the action of the spring 19 will gradually bring the system back to its normal position, in which light transmission through cable 15 is normal. It will be understood that the mechanical sensor illustrated in FIGS. 3-5 is only an embodiment of the invention, and a skilled person may easily devise other mechanical structures that will perform in the same way according to the principles of the invention.

Figure 6:
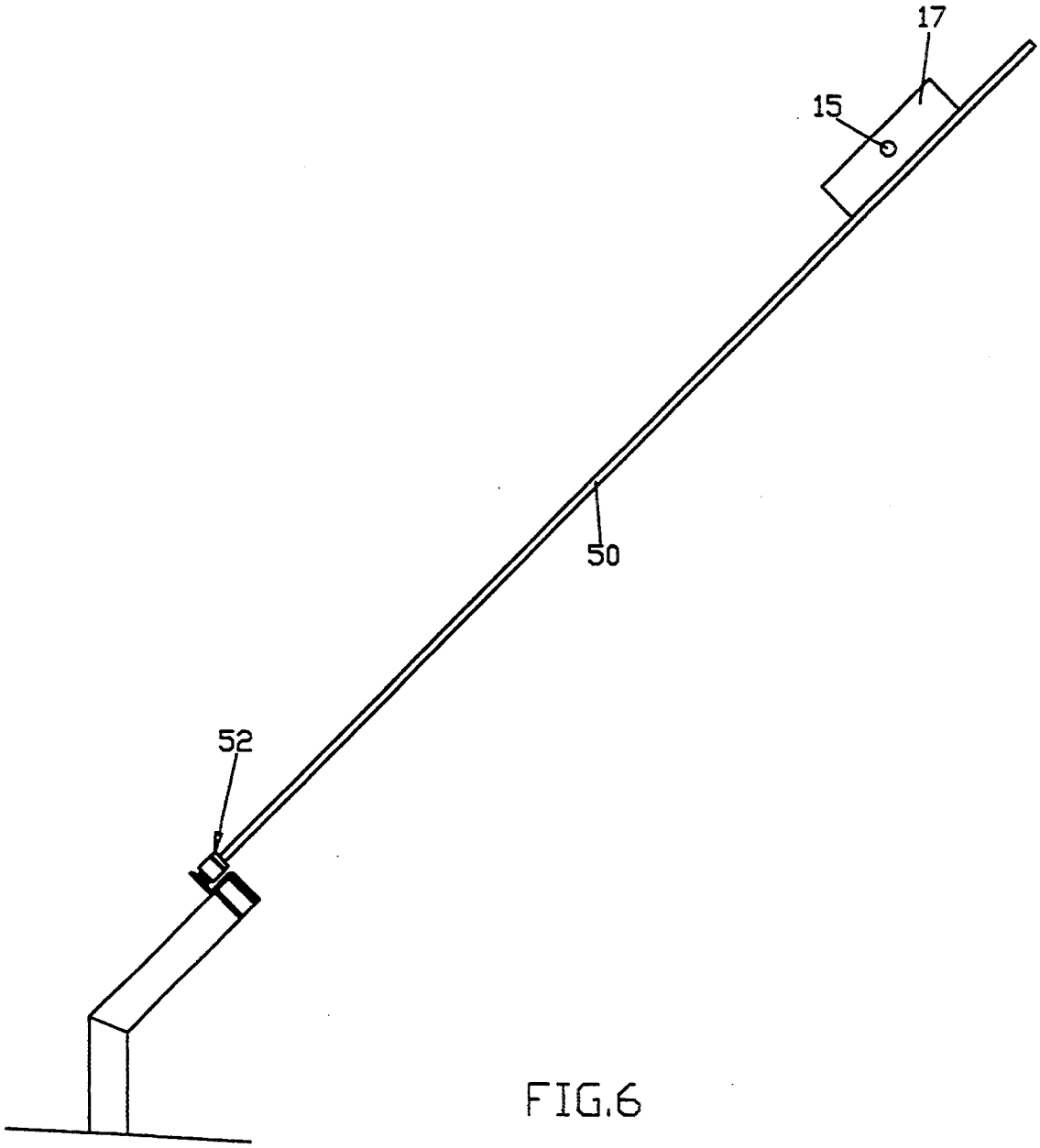
FIG. 6 schematically illustrates one of the supporting posts of the apparatus of FIG. 1, according to an embodiment thereof.

In a preferred form of the invention, posts 12 are as illustrated in FIG. 6. Sensor 17 is supported by a staff 50, which is connected through an essentially pivotal connection, generally indicated at 52, to the lower, vertical portion of the post 12. Pivotal connection 52 may be of any known structure, such as that used in vehicle steering wheels, which will yield when a significant load is placed on the staff 50 and particularly on its top, but will develop a sufficient elastical frictional resistance to rotation of the staff to maintain the same in its normal position, as shown in the drawings, when no significant vertical load is placed on it. Therefore, in this embodiment of the invention, if a considerable load is placed on the cables 15 or on the post itself, the post will collapse, causing unbalanced load to arise in the cables and the sensors to react by causing an alarm. In the absence of such loads, the tension of the cables 15 supports the apparatus and the posts do not collapse. However, the invention can be carried into practice by using non-collapsible posts, of any desired structure, as well.

Figure 7:
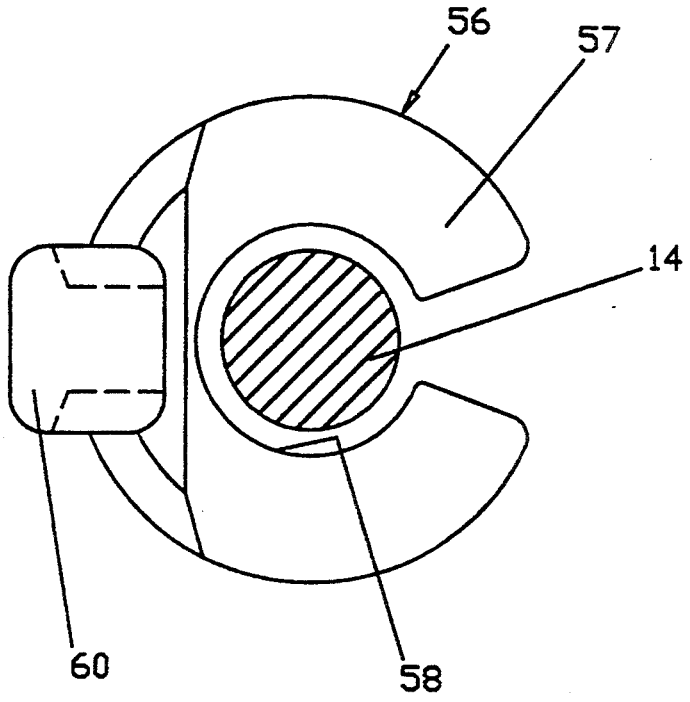
FIG. 7 is a plan view, looking downwards, of a detail of the apparatus.
Figure 8:
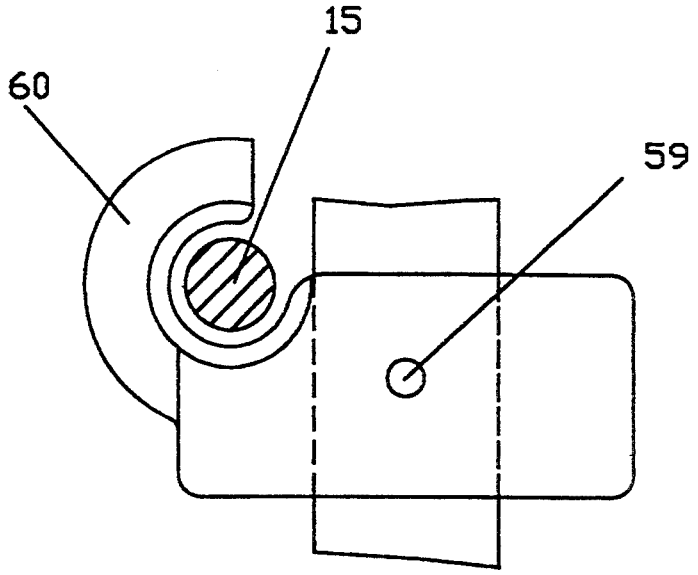
FIG. 8 is a vertical view of the same.

As noted, a number of spacers are provided in each-subsection of the apparatus, viz. between each pair of posts 12. Spacers 14 are vertical rods of any nature and structure, preferably of plastic and preferably flexible, the purpose of which is to maintain the various cables 15 at a substantially fixed vertical distance from one another, while allowing for free movement thereof along the longitudinal axis of the cable. For this purpose, spacers 14 may engage cables 15 e.g. by means of the joints 56 illustrated in FIGS. 7 and 8. Numeral 57 indicates a generally C-shaped body which defines a recess 58 into which is inserted the spacer 14 and which is connected thereto as schematically indicated at 59. Joint 56 has an upwardly curved projection 60, in which is introduced and supported a cable 15. Obviously in this way, vertical engagement is provided, while the cable may freely move horizontally. Obviously, many other mechanical devices, easily designed by skilled persons, could be provided for the same purpose.

While a preferred embodiment has been described by way of illustration, it will be obvious that persons skilled in the art may carry out the invention in a variety of different ways, without departing from the spirit of the invention or exceeding the scope of the appended claims. Any mechanical device that will react to unbalanced tensions and/or horizontal displacements of an optical cable in such a way as to cause a sharp bend in the cable and/or as to exert a pressure on it or pinch it, and in general to create a deformation that will significantly reduce transmission of light therethrough, will be suitable for carrying the invention into practice. It will also be appreciated that the optical cable, in the invention, carries out both the functions of a taut wire, in opposing intrusion and providing displacements for activating an alarm system in response to intrusion attempts, and the function of an optical wire, by reacting to cutting and/or to tensions and/or displacements caused by intrusion attempts, so as to reduce light transmission and activate an alarm. Complete intrusion detection is thus obtained with maximum reliability and with a minimum of component parts, and there, re with optimum efficiency and economy.

Figure 1:
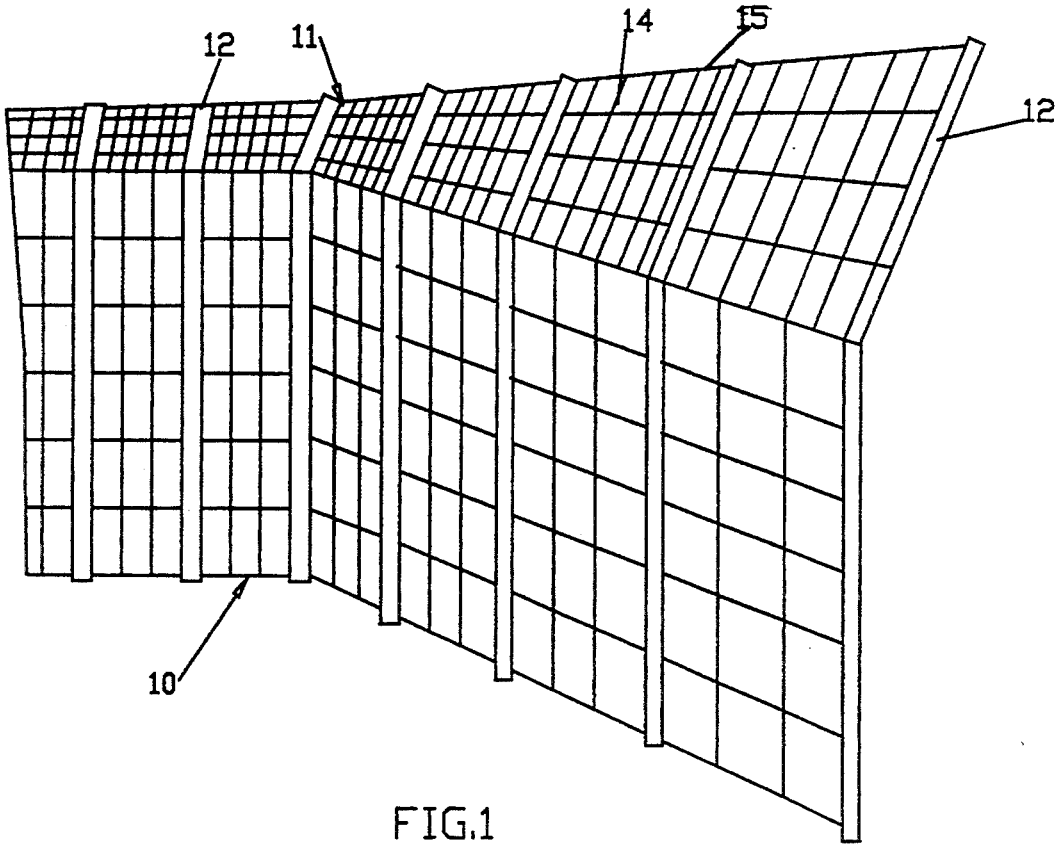
FIG. 1 is a schematic perspective view of an apparatus according to one embodiment of the invention.
Figure 9:
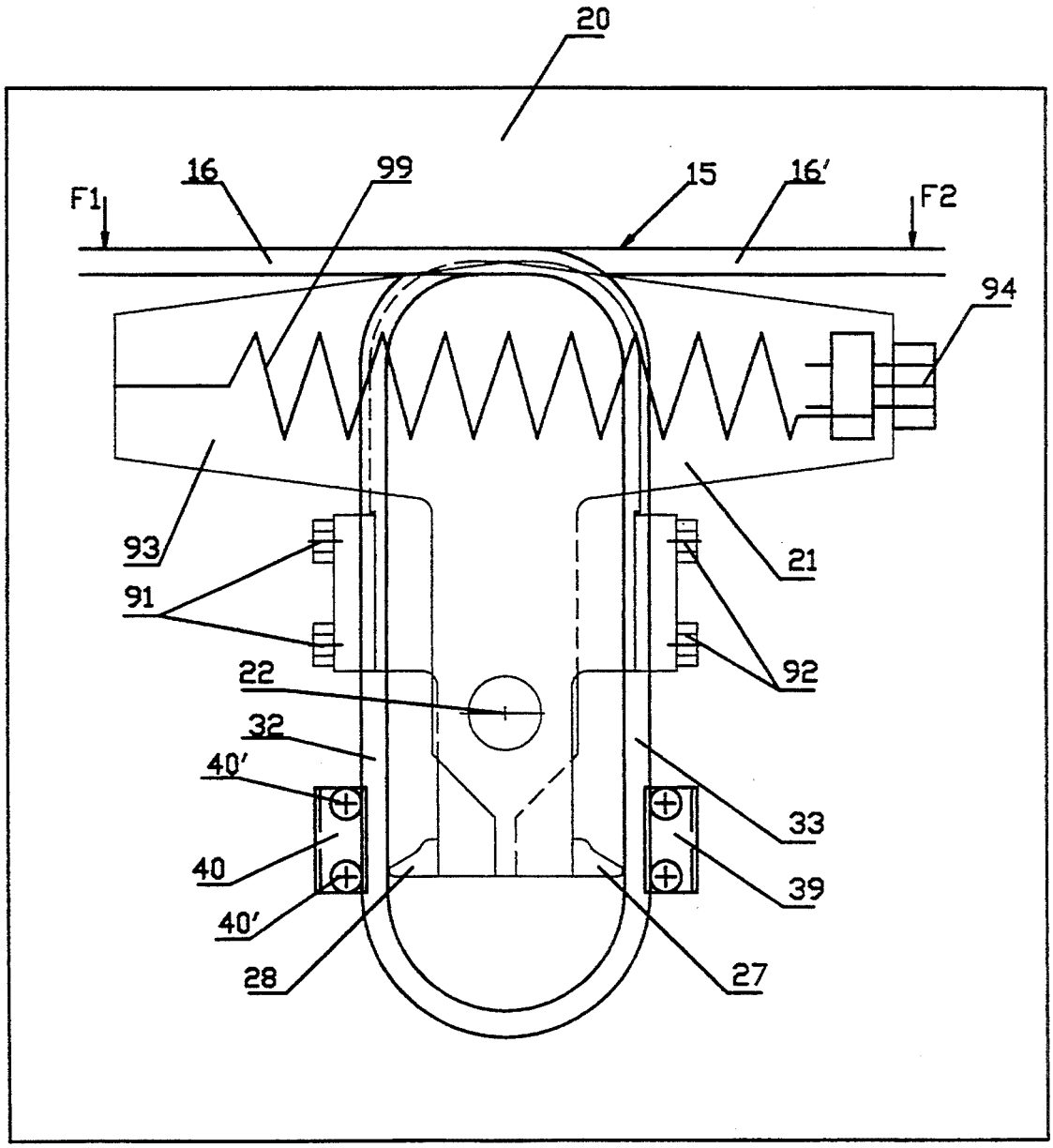
FIG. 9 is a front view of a cable-displacement sensing element, similar to that of FIG. 3.
Figure 10:
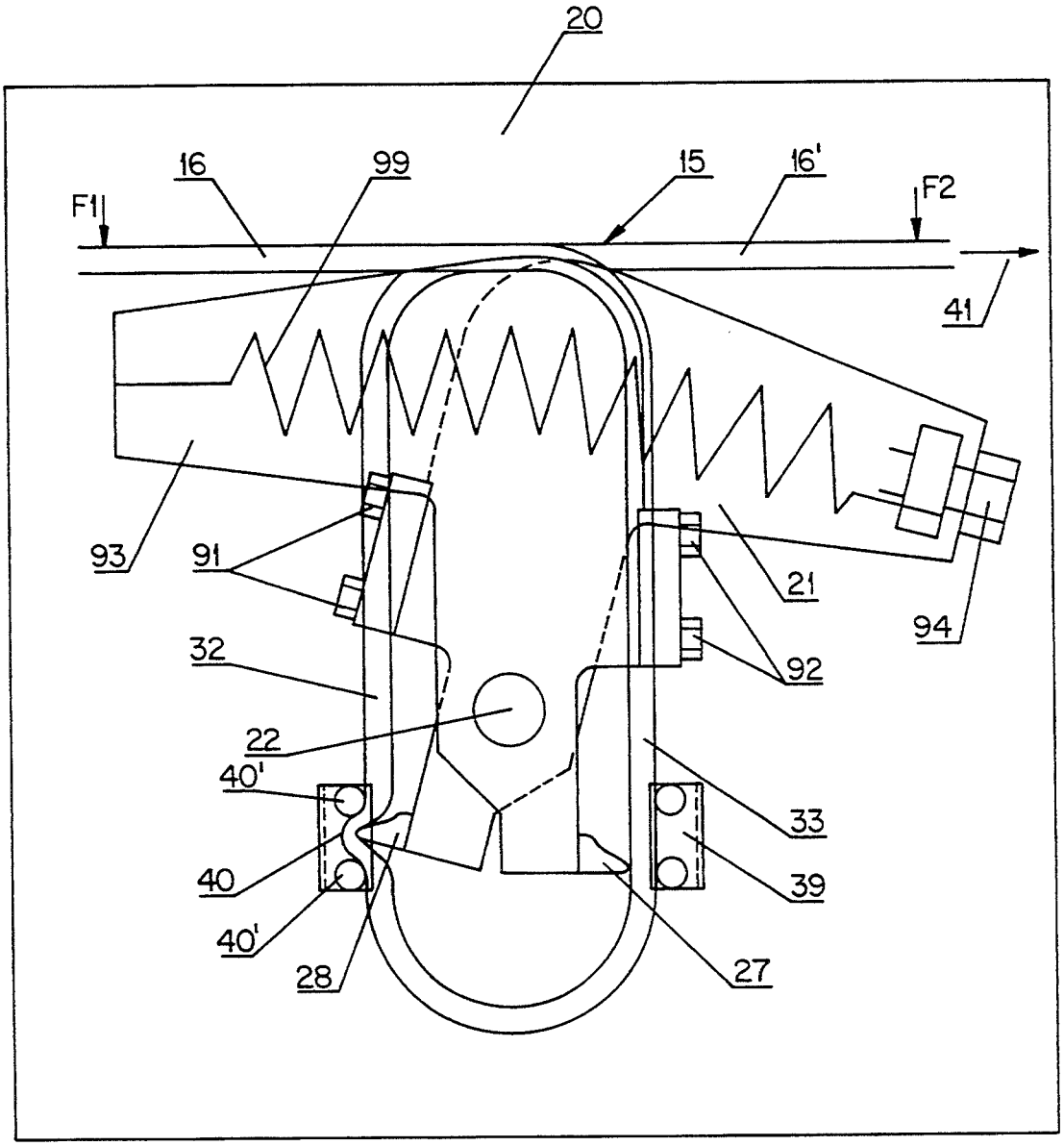
FIG. 10 is a front view of the sensing element of FIG. 9, displaced by an applied force so as to cause deformation of the optical cable.

In FIGS. 9 and 10 parts identical with those of FIG. 3 to 5 have been designated by the same numerals. The element sensing a displacement of the optical cable comprises a base plate 20 which is attached to a terminal post of FIG. 1, or to a support member rigidly attached thereto. To base plate 20 there are attached members 21 and 93, both of which can turn about axis 22. End 16' of the optical cable 15 is rigidly attached to plate 21 by means of screws 91 while end 16 of the optical cable 15 is attached to a plate 93 by means of screws 92, so that end 16' makes a loop and returns via end 16. A spring 99 is provided between the two plates 21 and 93, and tensions the optical cable, whereby the tension can be adjusted by means of screw 94. When a force F2, indicated by an arrow, exceeding a predetermined threshold value, is applied to cable 15, plate 21 will be turned about axis 22, against spring 99. Protrusion 28, which is part of plate 21, is urged against the cable and against the plate 40, on which are mounted two pins 40', thus causing a deformation of the cable schematically indicated in FIG. 10, which causes a light signal attenuation, actuating the alarm system.

When a force F1 is applied, the movement is in the opposite direction, and protrusion 27 will be urged against plate 39, thus actuating the alarm.

I claim:

1. An intrusion detection system, comprising a fence incorporating at least one optical cable extending along the fence, with mechanical sensing means attached along the optical cable at intervals from each other, there being provided at one end of the cable a light source passing light via the optical cable, and at the other end of the cable light sensing means with means for evaluating the intensity of the light passing through the optical cable, such sensing means being adapted to actuate a mechanical member provided with means maintaining the mechanical member in a neutral position until a force exceeding a certain value is applied to the cable, which force actuates the mechanical member causing displacement and deformation of the optical cable, said sensing means comprising differential displacement mechanical sensing means which comprise presser means inactive in a normal position and displaceable to an active position wherein a concentrated pressure on said cable is exerted so as to displace said cable in the direction of displacement of the presser means, wherein the differential displacement mechanical sensing means comprises means for limiting the displacement of the cable caused by the presser means, said limiting means cooperating with the presser means to deform the cable, wherein the presser means is tapered to a dull edge in the direction of displacement and the limiting means is provided with corresponding recesses which permit displacement and/or deformation of the cable as a result of the presser means abutting the cable and driving the cable into one of said recesses, while limiting displacement of the cable at the sides of said one of said recesses, whereby, when a force is applied to the fence, said presser means exerts adequate pressure on the optical cable to cause light intensity attenuation, said light attenuation being sensed by the light sensing means, actuating an alarm.

2. An intrusion detection system according to claim 1, wherein the fence is provided with a plurality of optical cables at different heights, so as to detect intrusion attempts at a variety of levels.

3. Intrusion detection structure according to claim 1, wherein the displacment of the presser means results from a rotation about a fixed pivot, caused by a rotary moment produced by the displacement of the optical cable in frictional engagement with an element of the mechanical sensing means.

4. Intrusion detection system according to claim 1, comprising posts for supporting the optical cable, through a differential displacement mechanical sensing device, located at intervals from each other along the fence.

5. Intrusion detection structure according to claim 4, wherein the posts comprise a fixed lower portion and an upper portion pivotally connected to said lower portion for downward folding by a vertical load above a predetermined limit.

6. Intrusion detection system according to claim 1, comprising vertical spacers for engaging the optical cable or cables, and maintaining them in substantially constant vertical positioned relationship, while permitting free horizontal displacement thereof, at intermediate points of the length of the fence.

* * * * *